US007975599B2

(12) United States Patent
Geissler et al.

(10) Patent No.: US 7,975,599 B2
(45) Date of Patent: Jul. 12, 2011

(54) REGULATING DEVICE FOR A HYDROSTATIC PISTON ENGINE WITH ELECTRONIC CONTROL UNIT

(75) Inventors: Grit Geissler, Dresden (DE); Olaf Bartels, Bietigheim (DE); Juergen Gintner, Elchingen (DE); Andreas Dambacher, Marktgroeningen (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 745 days.

(21) Appl. No.: 11/990,105

(22) PCT Filed: Aug. 8, 2006

(86) PCT No.: PCT/EP2006/007845

§ 371 (c)(1),
(2), (4) Date: Mar. 7, 2008

(87) PCT Pub. No.: WO2007/017251

PCT Pub. Date: Feb. 15, 2007

(65) Prior Publication Data

US 2010/0224058 A1 Sep. 9, 2010

(30) Foreign Application Priority Data

Aug. 9, 2005 (DE) ..... 10 2005 037 620

(51) Int. Cl.
*F01B 3/00* (2006.01)
*F01B 31/12* (2006.01)

(52) U.S. Cl. ..... 92/12.2; 92/5 R; 91/504

(58) Field of Classification Search ..... 91/1, 504, 91/505, 506; 92/5 R, 12.2
See application file for complete search history.

(56) References Cited

U.S. PATENT DOCUMENTS

| | | | | |
|---|---|---|---|---|
| 6,394,206 | B1 | 5/2002 | Fury | |
| 6,802,243 | B2 * | 10/2004 | Matsuda et al. | 92/12.2 |
| 7,124,677 | B2 * | 10/2006 | Kadlicko | 92/12.2 |
| 7,380,490 | B2 * | 6/2008 | Kadlicko | 91/505 |

FOREIGN PATENT DOCUMENTS

| | | | |
|---|---|---|---|
| DE | 195 40 654 | C1 | 12/1996 |
| DE | 100 06 405 | A1 | 9/2001 |
| EP | 0 955 465 | A2 | 11/1999 |

* cited by examiner

*Primary Examiner* — Michael Leslie
(74) *Attorney, Agent, or Firm* — Scully, Scott, Murphy & Presser, P.C.

(57) ABSTRACT

A regulating device for a hydrostatic piston engine is provided. The regulating device (30) has an electronic control unit (17) for generating adjusting signals. An adjusting position of the hydrostatic piston engine scanned by a feedback element (36, 61) is detected by a sensor element (42) of the electronic control unit (17) without contact.

10 Claims, 5 Drawing Sheets

REGULATING DEVICE FOR A HYDROSTATIC PISTON ENGINE WITH ELECTRONIC CONTROL UNIT

BACKGROUND

The invention relates to a regulating device for a hydrostatic piston engine.

Hydrostatic piston engines which can be adjusted in their absorption or discharge volume are usually used for operating hydrostatic drives. In this case an adjusting device, triggered by a regulating device, acts on an adjusting mechanism of the hydrostatic piston engine.

From DE 195 40 654 C1 a regulating valve is known for this purpose, in which a valve piston is arranged as longitudinally displaceable in a valve housing. The valve piston can be charged with a control pressure on each of its end faces orientated in opposite directions. By an axial movement of the valve piston in one direction an input pressure connection is connected to a first output by displacing the sealing area. Simultaneously a second output is connected to a tank connection. On a movement in the opposite direction the second output connection is connected to the input connection and simultaneously the first output connection is connected to the tank connection. The resulting adjusting movement of the adjusting piston is fed back to the valve piston via a feedback element, in order to achieve an adjustment of the adjusting piston proportional to the force acting on the end face of the valve piston. The adjusting movement is transmitted by the feedback element and steers out one of two legs. The two legs are connected to one another via a spring, the leg not steered out in each case being supported on a catching pin of the valve piston. The known adjusting device has the disadvantage that the mechanical feedback involves a considerable outlay.

SUMMARY

The object of the invention is to create a regulating device for a hydrostatic piston engine, which enables simple detection of the position of the adjusting piston.

The regulating device according to the invention for a hydrostatic piston engine comprises an electronic control unit. The electronic control unit is provided for generating adjusting signals. So that the electronic control unit can take into account the respective current position of the pivoting angle of the hydrostatic piston engine, a feedback element is provided in the regulating device. The feedback element scans the adjusting position of the hydrostatic piston engine. The adjusting position scanned by the feedback element is detected without contact by a sensor element integrated in the electronic control unit.

Because of the provision of a sensor element which detects a scanned adjusting position without contact, there is no need for the mechanical feedback. The sensor element can therefore be provided on a printed circuit board of the electronic control unit and cabling is not required. Simultaneously, by the provision of a sensor element for contactless detection, mounting safety and operating safety are increased. By contrast with mechanical feedback of the adjusting position to a regulating valve, the position is detected without contact and immediately taken into account in the adjusting signal generated. Finally, the contactless detection of the scanned adjusting position allows sealing of the electronic components from the areas of the hydrostatic piston engine which are oil-bearing.

Advantageous further developments of the regulating device according to the invention are listed in the subordinate claims.

It is particularly advantageous to construct the regulating device with a first and a second housing part. The electronic control unit may in this case be arranged in a first housing part and the feedback element in a second housing part. The division provides a simple option for separating the electronic components and the mechanical/hydraulic components from one another. The two housing parts can in particular be sealed against one another in a simple manner.

Particularly simple transmission and detection of the adjusting position of an adjusting device of the hydrostatic piston engine can be achieved, if a magnetic element is provided on the feedback element and the electronic control unit has a magnetically sensitive sensor element. If the two housing parts, in which the electronic control unit or the mechanical/hydraulic components are preferably arranged, consists of a material which, for example, prevents optical detection of the adjusting position, contactless detection of the adjusting position is easily possible by using a magnet in combination with a magnet-sensitive sensor element.

A particularly favourable arrangement emerges if the feedback element has a shaft which is held rotatably in the regulating device. By means of such a rotatably held shaft a measuring variable for the scanned adjusting position of the hydrostatic piston engine can be determined in a small construction space on the basis of the angle of the shaft of the feedback element.

To translate, in most cases, a linear adjusting movement of an adjusting device of the hydrostatic piston engine into an item of angle information, a feedback lever is preferably non-rotatably connected to the shaft of the feedback element. The feedback lever can be guided out of a housing of the regulating device in such a way that the entire regulating device is placed as a modular component on to an existing hydrostatic piston engine of conventional design. The feedback elements of conventionally mechanically fed back engines can be partially reused. For this purpose the feedback lever engages in a corresponding recess of the adjusting device of the hydrostatic piston engine. The linear movement is converted into a rotating movement of the shaft by the feedback lever which is non-rotatably connected to the shaft. In this case the magnetic element is particularly preferably arranged on the shaft. The magnetic element is preferably arranged on the end face of the shaft, so when the shaft rotates a constant distance between the magnetic element and the sensor element on the printed circuit board of the electronic control unit is guaranteed.

The angle of the magnetic element and therefore the adjusting position of the hydrostatic piston engine can be detected in a particularly simple manner by a Hall sensor as sensor element or by a magneto-resistive resistor.

It is further advantageous to detect the temperature of the hydrostatic piston engine directly in the electronic control unit. For this, a temperature sensor is arranged in the electronic control unit. The close arrangement of the electronic control unit on the hydrostatic piston engine provides a clear connection between the operating temperature of the hydrostatic piston engine and the temperature measured in the electronic control unit.

In order to further improve detection of the temperature of the hydrostatic piston engine, the first housing part and the second housing part are preferably constructed of a metal material, so the temperature sensor of the electronic control unit measures a virtually identical temperature to the operating temperature of the hydrostatic piston engine.

A preferred embodiment example of the regulating device according to the invention is illustrated in the drawings and is explained in greater detail in the following description.

DETAILED DESCRIPTION OF EXEMPLARY EMBODIMENTS

Figure 1:
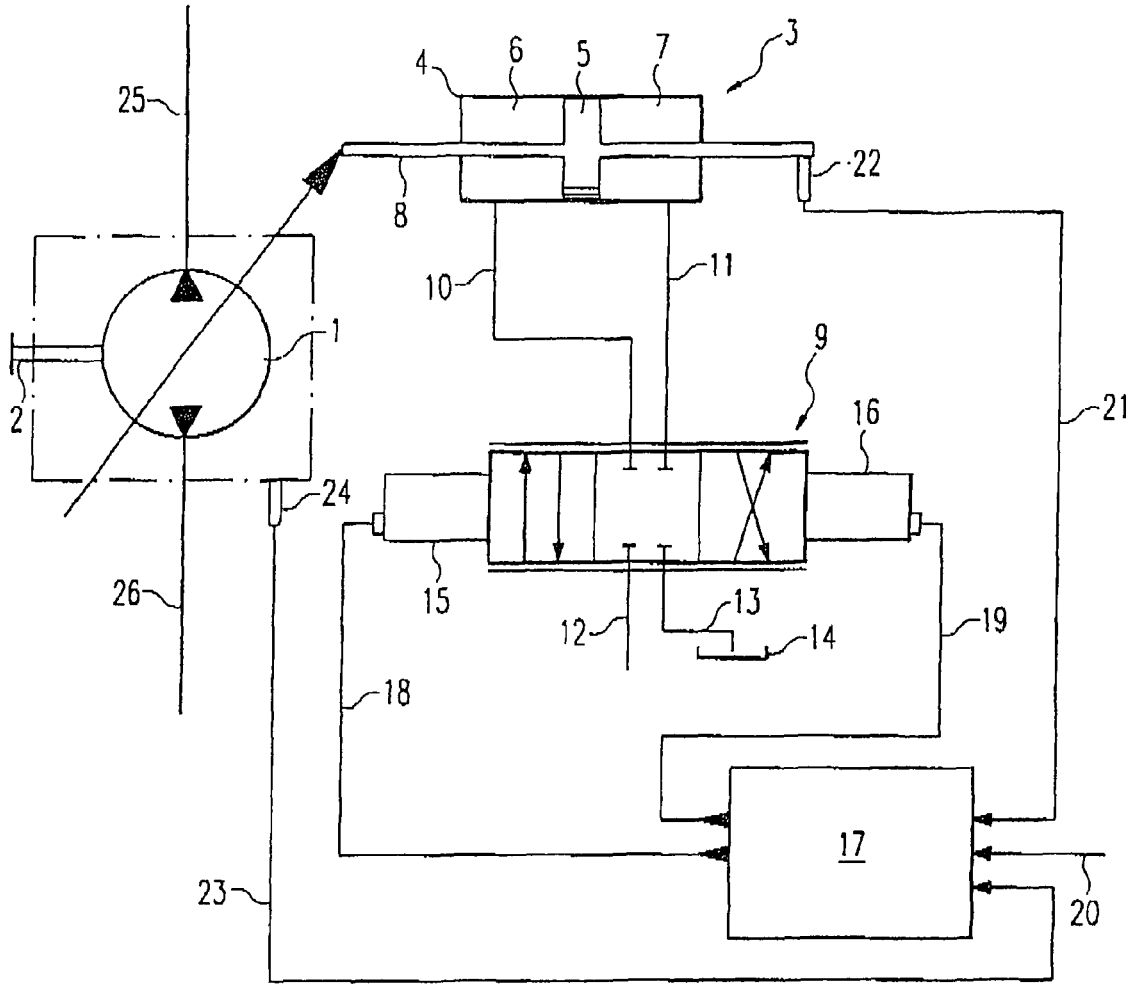
FIG. 1 shows a schematic illustration of the regulation of a hydrostatic piston engine.

Before examining the configuration of the regulating device according to the invention, firstly, using the schematic wiring diagram of FIG. 1, the objects which must be fulfilled by the regulating device according to the invention will be explained. In FIG. 1 a hydrostatic piston engine 1 is designed as an adjustable pump. The hydrostatic piston engine 1 is driven via a drive shaft 2. A diesel engine of a machine acts as drive motor, for example.

An adjusting device 3 acts on the adjusting mechanism of the hydrostatic piston engine 1. The adjusting device 3 has a cylinder 4, in which an adjusting piston 5 is arranged as longitudinally displaceable. The adjusting piston 5 has two adjusting pressure faces, facing in opposite directions, by which the cylinder 4 is divided into a first adjusting pressure chamber 6 and a second adjusting pressure chamber 7. Provided for transmitting the adjusting movement of the adjusting piston 5 is a piston rod 8, which is mechanically coupled to the adjusting mechanism of the hydrostatic piston engine 1.

The adjusting movement of the adjusting piston 5 is generated by setting appropriate adjusting pressures in the first adjusting pressure chamber 6 and the second adjusting pressure chamber 7. To set the adjusting pressures, an adjusting pressure regulating valve 9 is provided, which charges the first adjusting pressure chamber 6 or the second adjusting pressure chamber 7 with an adjustable pressure via a first adjusting pressure line 10 and a second adjusting pressure line 11. The adjusting pressure regulating valve 9 is a 4/3 directional control valve, by which the first adjusting pressure line 10 or the second adjusting pressure line 11 can be connected alternately to a pressure feed line 12 or a pressure relief line 13. Via the pressure relief line 13 pressure means, taken from one of the adjusting pressure chambers 6, 7 is relieved into the tank volume 14. The adjusting pressure regulating valve 9 is continuously adjustable between its two end positions. The position of the adjusting pressure regulating valve 9 is fixed by a first electromagnet 15 and a second electromagnet 16. The adjusting pressure regulating valve 9 is preferably a proportional valve. Various embodiments of such a proportional valve in the form of proportional directional control valves or pressure-reducing valves are explained later with reference to FIGS. 5 to 9.

The adjusting signals for the electromagnets 15, 16 are generated by an electronic control unit 17 and conveyed to the electromagnets 15, 16 via adjusting signal lines 18 or 19.

In order to be able to determine the adjusting signals for the first electromagnet 15 or the second electromagnet 16, various input variables are fed to the electronic control unit 17. As well as the central input variable, which is fed, for example, by a driving lever default of an operator via a line 20, these are, e.g. variables of the hydraulic system itself. In addition to detection of the pressures prevailing in the operating lines 25, 26, not separately illustrated in FIG. 1, detection of the actual adjusting position of the adjusting piston 5 is also necessary to fix the adjusting signals for the first electromagnet 15 and the second electromagnet 16.

The actual adjusting position of the adjusting piston 5 corresponds to the set absorption or discharge volume of the hydrostatic piston engine 1. In the schematic illustration of FIG. 1 a sensor element 22 is provided for this, which conveys the detected position of the central computing unit of the electronic control unit 17 via a measuring line 21. The illustration of the detection of the adjusting position of the adjusting piston 5 outside the electronic control unit 17 is chosen in FIG. 1 simply for better understanding. In the preferred regulating device according to the invention the position detection is actually integrated into the regulating device. Furthermore, the actual temperature of the hydrostatic piston engine 1 is preferably determined by a temperature sensor 24 and in turn conveyed via a measuring line 23 to the computer of the electronic control unit 17. Determination of the temperature is preferably done in the case of the regulating device according to the invention inside the electronic control unit 17 and is illustrated by a temperature sensor element on the hydrostatic piston engine 1 for purposes of illustration only. Accordingly, the measuring lines 21 and 23 in the regulating device according to the invention are preferably formed by strip conductors on a printed circuit board of the electronic control unit 17 and the sensors are arranged on the printed circuit board.

Figure 2:
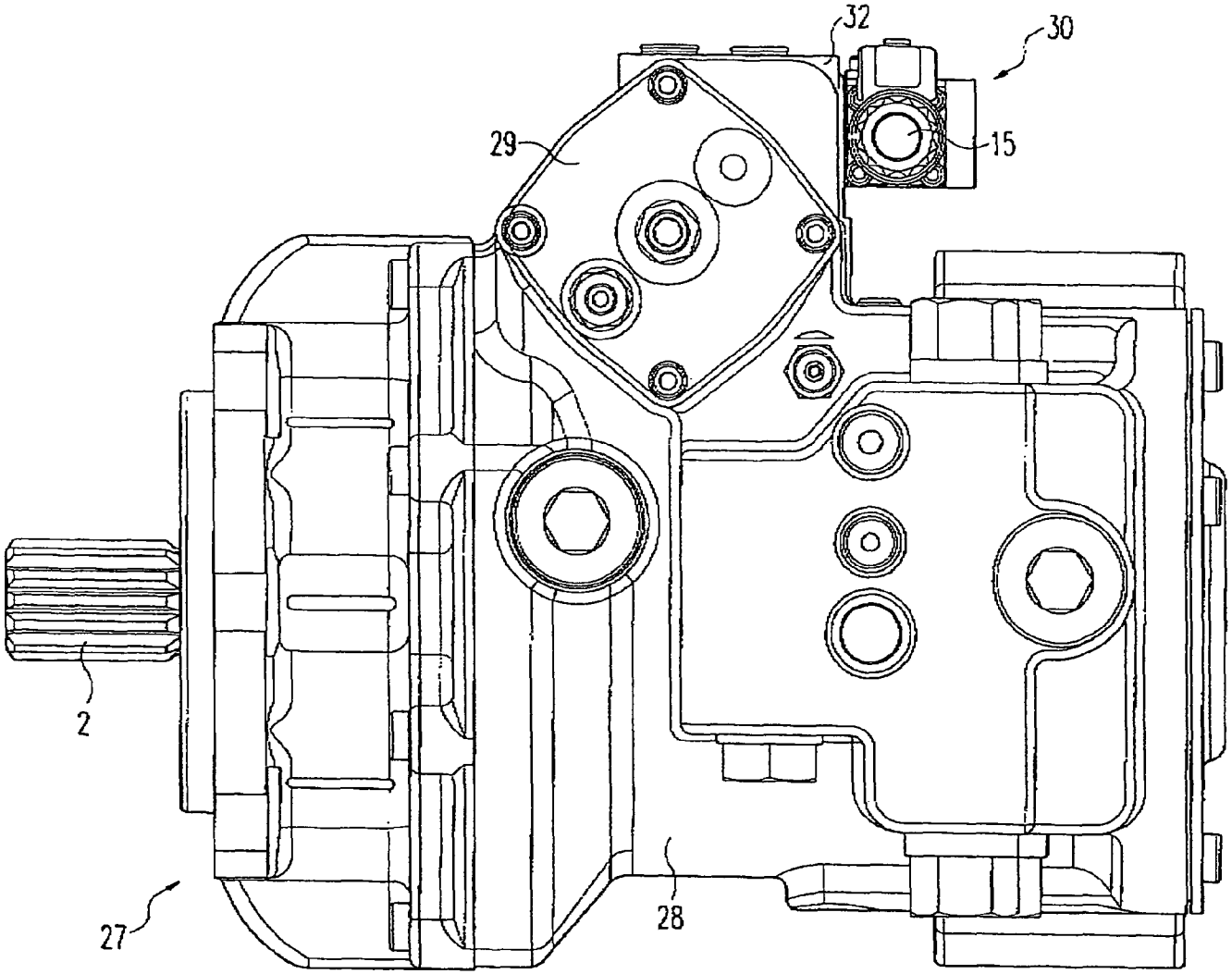
FIG. 2 shows a side view of a hydrostatic piston engine with a regulating device according to the invention built on to it.

FIG. 2 illustrates the arrangement of the regulating device according to the invention on a hydrostatic piston engine 27. FIG. 2 shows a side view of a hydrostatic piston engine 27 with a housing 28. Protruding from the housing 28 is the drive shaft 2. In one housing section an adjusting device with the adjusting piston 5 is constructed, which is closed by a cover 29. In the hydrostatic piston engine 27 illustrated in FIG. 2 the adjusting piston 5 executes a linear adjusting movement running perpendicular to the plane of projection. The regulating device 30, which in the preferred embodiment example illustrated in FIG. 2 is an integrated assembly with the control pressure regulating valve 9, is arranged laterally on one housing part 32. The regulating device 30, in which in FIG. 2 the end face of electromagnet 15 can be seen, is preferably screwed to housing part 32. The adjusting piston 5 has a recess into which a feedback lever protruding out of the housing of the regulating device 30 engages. This is made clear below with reference to FIGS. 3 and 4.

Figure 3:
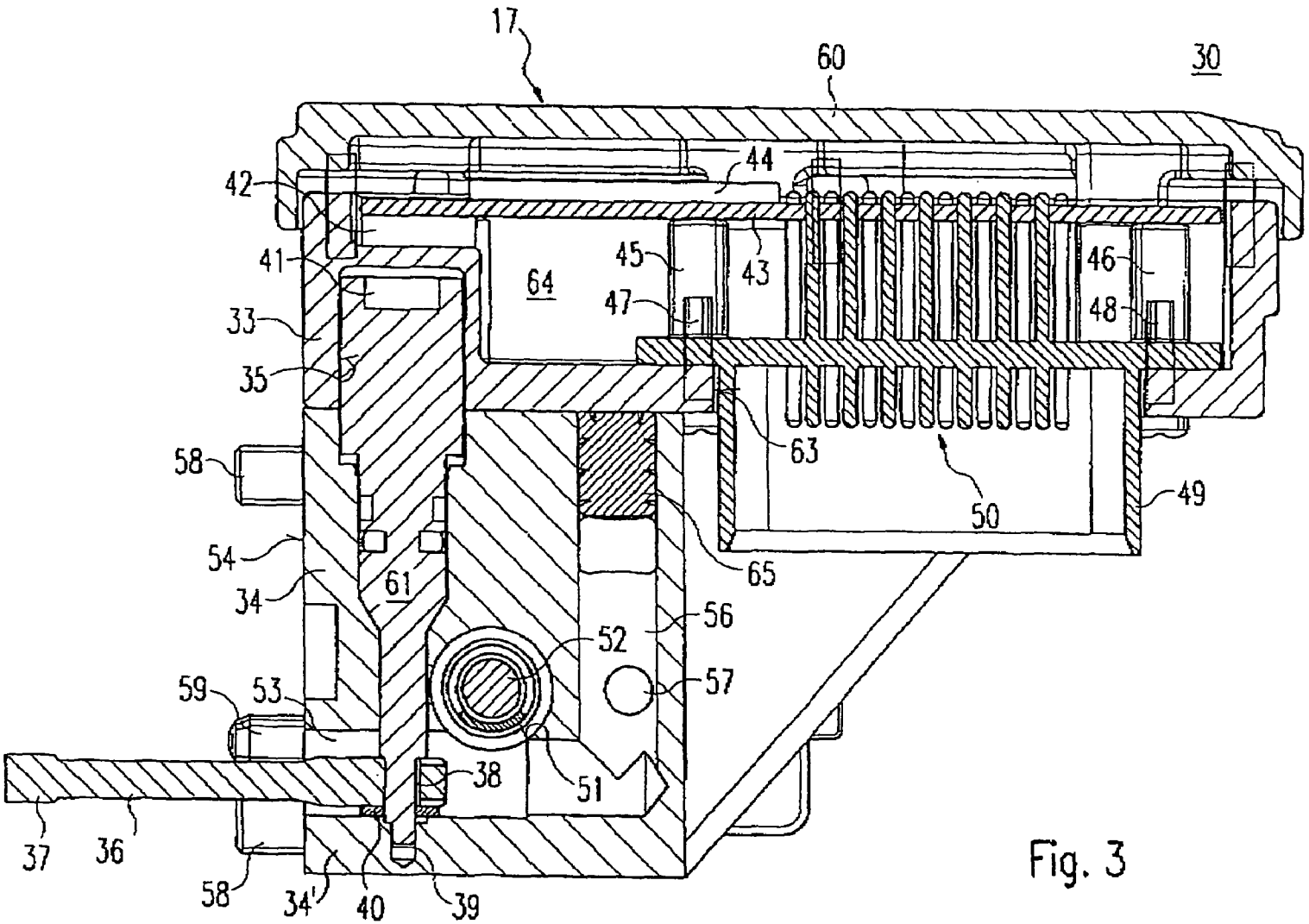
FIG. 3 shows a sectional illustration through a regulating device according to the invention.

FIG. 3 shows a section through the regulating device 30 according to the invention. The regulating device 30 according to the invention has a first housing part 33 and a second housing part 34. In the first housing part 33 and the second housing part 34 a common, graduated recess 35 is introduced, in which a shaft 61 is arranged. The first housing part 33 here acts simultaneously as a cover for the second housing part 34. Penetration of pressure means into the first housing part 33 from the second housing part 34 is therefore ruled out and housing parts 33, 34 are sealed against one another. The shaft 61 forms a feedback element with a feedback lever 36. On its end facing away from the shaft 61 the feedback lever 36 has a thickened area constructed as a head 37, with which it engages in the adjusting piston 5 of the adjusting device 3. The position of the adjusting piston 5 is in this case chosen in such a way that it moves linearly perpendicular to the plane of projection. To scan the adjusting position of the adjusting piston 5 the feedback lever 36 is rotated about the axis of the shaft 61 by the adjusting movement of the adjusting piston 5.

The feedback lever 36 has an eye 38, which is penetrated by the shaft 61. The geometry of the eye 38 and the geometry of the shaft 61 at this point are chosen in such a way that a rotating movement of the feedback lever 36 means a rotation of the shaft 61 in the recess 35. On its feedback-lever-side end the shaft 61 has a bolt-shaped extension which engages in a pocket hole 39 of the second housing part 34 and thus enables improved bearing of the shaft 61. Between the feedback lever 36 and a wall 34' of the second housing 34 is arranged a spacer disc 40 to keep the friction between the feedback lever 36 and the wall 34' as low as possible.

On the end of the shaft 61 facing away from the connection to the feedback lever 36 is constructed a magnet receptacle 41. In the embodiment example illustrated the magnet receptacle 41 is implemented on the end face of the shaft 61 by a countersunk groove. A magnet, not illustrated in the drawing, is inserted into this groove. The magnet is preferably designed as a permanent magnet.

In the neutral position illustrated in FIG. 3, which, for example, corresponds to a zero stroke setting of the hydrostatic piston engine, the N-S axis of an inserted magnet runs perpendicular to the plane of projection, for example. The position of the magnet inserted into the magnet receptacle 41 is detected by a sensor element 42. The sensor element 42 is arranged on a printed circuit board 43 of the electronic control unit 17. On the printed circuit board 43 is additionally arranged the central computer unit 44 of the electronic control unit 17 for determining the adjusting signals. The printed circuit board 43 is held by a first spacer 45 and a second spacer 46, which are inserted in the first housing part 33 via a first bolt 47 or a second bolt 48. Simultaneously a plug housing 49 is fixed in a recess 63 of the first housing part 33 by the first spacer 45 and the second spacer 46. The plug housing 49 is preferably constructed as a plastics material moulded part, the plastics material moulded part being injected round the connection pins 50 and the inside of the electronic control unit 17 thus being sealed, e.g. against humidity from the environment. The plane in which the printed circuit board 43 is arranged is preferably perpendicular to the rotational axis of the shaft 61. This allows the overall height required in any case because of the valve to be used to attach a connector plug on the side of the electronic control unit 17 facing the piston engine.

In the first housing part 33 is constructed an accommodating space 64 for accommodating the electronic control unit 17. This accommodating space 64 is closed by a cover 60, by which simultaneously the printed circuit board 43 is held down and is thus fixed on the first spacer 45 and the second spacer 46. The part of the recess 35 which is constructed in the first housing part 33 is inserted into the first housing part 33 from outside and has no connection to the accommodating space 64. Scanning the relative position of the magnet, inserted into the magnet receptacle 41, by the sensor element 42 takes place through the housing wall without contact. For this purpose the flux lines of the permanent magnet penetrate through the wall of the first housing part 33 in the area between the magnet receptacle 41 and the sensor element 42. For detecting the relative position of the permanent magnet the sensor element 42 is preferably designed as a Hall sensor, which, e.g. reacts to changes of angle of a parallel magnetic flux density. Alternatively the sensor element 42 may also be constructed as a magneto-resistive element.

In addition to recess 35, in the second housing part 34 a valve piston recess 51 is provided, in which a valve piston 52 is arranged as longitudinally displaceable. In the sectionalised area illustrated the valve piston recess 51 is connected to a duct 53, which ends at a contact face 54 of the second housing part 34. The duct 53 stands perpendicular on the recess 35 and enables the feedback lever 36 to be guided outwards out of the second housing part 34. The contact face 54 constructed on the outside serves to fasten the regulating device 30 to the housing part 32 of the adjusting device of the hydrostatic piston engine 27.

Likewise connected to the duct 53 is a bore 56, which in turn intersects with a bore 57. Bores 56, 57 act jointly with the duct 53 to feedback pressure medium in the direction of a tank volume, not illustrated.

In order to prevent leaked medium escaping from the second housing part 34, the bore 56 is closed with a plug 65. For fastening, threaded pins 58 protrude out from the contact face 54, via which the regulating device 30 can be screwed to the housing part 32. Additionally to be seen is an alignment pin 59, via which the exact position of the regulating device 30 is fixed in respect of the housing part 32, in order, for example, to enable secure sealing of adjusting pressure ducts guided through the contact face 54.

The use of sensors arranged on the printed circuit board for detecting temperature and position allows improved consideration of operating parameters, without additional external sensors. In particular, a neutral position can be varied by software and temperature-dependent swivelling back behaviour implemented, wherein ventilator control can also be integrated.

Figure 4:
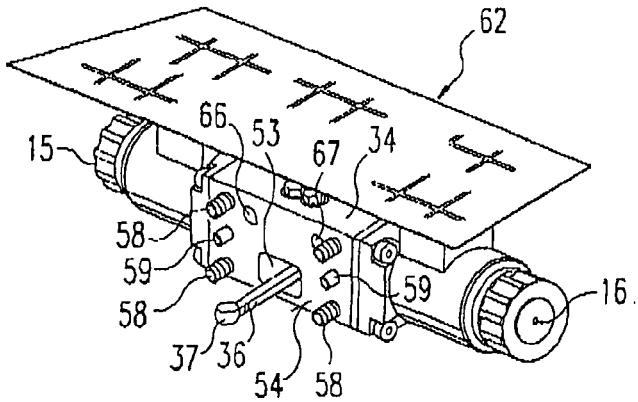
FIG. 4 shows a perspective illustration of a build-on module with the regulating device according to the invention.

A greatly simplified illustration of a regulating device 30 according to the invention in perspective view is illustrated again in FIG. 4. The electronic control device 62 is indicated in this case solely by a placed-on circuit board. The contact face 54 of the second housing part 34 can be seen in FIG. 4. The electromagnets 15, 16 extend on both sides of the second housing part 34. Protruding from the contact face 54 out of the duct 53 is the feedback lever 36, on the protruding end of which the head 37 is constructed. Likewise constructed on the contact face 54 are the threaded joints 58 and two alignment pins 59. To convey pressure in the direction of the adjusting pressure chambers, orifices 66, 67 are provided in contact face 54, which is fastened sealed against the housing part 32.

FIGS. 5 to 9 illustrate several alternatives to the construction of the control pressure regulating valve 9 of FIG. 1 or alternative forms by using two directional control valves or two pressure-reducing valves. Instead of the electromagnets 15, 16 shown, however, in all the embodiments it is equally possible to generate the required adjusting forces by using control pressures. For this, for generating the force to actuate the proportional directional control valve 90 on the end face of the proportional directional control valve 90 in each case, it is preferred to provide a pilot valve which on its part is triggered by the electronic control unit 17. Otherwise, the function corresponds to that of the control pressure regulating valve 9 illustrated in FIG. 1.

Figure 5:
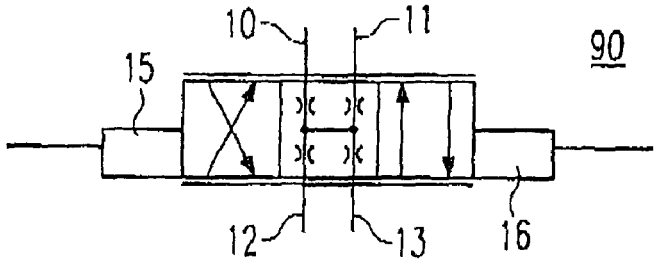
FIG. 5 shows a first example of an alternative control pressure-regulating valve.

FIG. 5 illustrates a first alternative of the control pressure regulating valve 9 of FIG. 1. In addition to the end position already explained with reference to FIG. 1, the proportional valve 90 shown in FIG. 5 has, a neutral position in which the first adjusting pressure line 10, the second adjusting pressure line 11, the pressure feed line 12 and the pressure relief line 13 are connected to one another in throttled manner. In the neutral position of the proportional directional control valve 90 all four connections of the proportional directional control valve 90 are connected to one another in throttled manner for this purpose. Triggering takes place in the embodiment example illustrated in FIG. 5 by electromagnets 15, 16 in the same way as with the control pressure regulating valve in FIG. 1.

Figure 6:
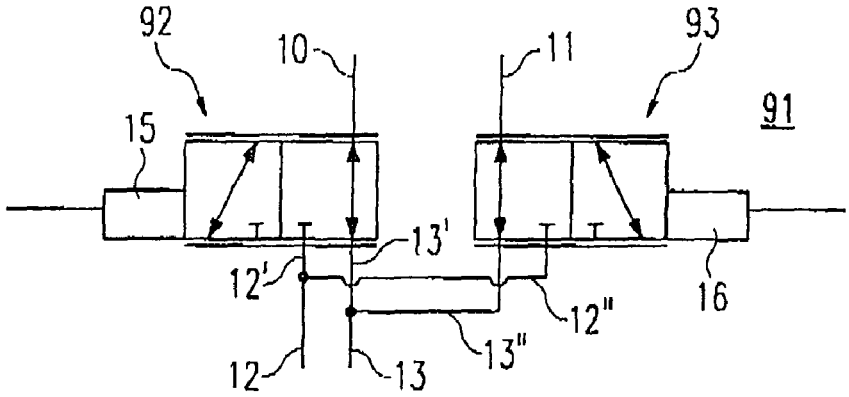
FIG. 6 shows an alternative embodiment to the control pressure-regulating valve with two directional control valves.

FIG. 6 illustrates as an alternative a proportional directional control valve unit 91. The proportional directional control valve unit 91 comprises a first 3/2 directional control valve 92 and a second 3/2 directional control valve 93. The use of two 3/2 directional control valves has the advantage that valves can be used which are produced in larger piece numbers and are therefore obtainable at a reasonable price. For parallel connection of the first proportional directional control valve 92 and the second proportional directional control valve 93, the pressure feed line 12 branches into a first line section 12' and a second line section 12". The pressure relief line 13 likewise branches into a first pressure relief line section 13' and a second pressure relief line section 13".

The initial position of the two 3/2 directional control valves 92, 93 illustrated in FIG. 6 corresponds to the neutral position of the proportional directional control valve 90 illustrated in FIG. 5. For charging the first or the second adjusting pressure line 10, 11 with an appropriate adjusting pressure, one of the two electromagnets 15, 16 is charged with an adjusting signal and the corresponding first or second 3/2 directional control valve 92 or 93 is placed in the direction of its end position. In the end position of the first 3/2 directional control valve 92 the first line section 12' is connected to the first adjusting pressure line 10. Simultaneously the second adjusting pressure line 11 remains connected to the pressure relief line 13 via the second pressure relief line section 13". For charging the adjusting piston 5 with an adjusting force in the opposite direction the signal of the first electromagnet 15 is reset and instead the second electromagnet 16 is energised. This means that the first adjusting pressure line 10 is connected to the pressure relief line 13 via the first pressure relief line section 13', while simultaneously the second adjusting pressure line 11 is connected to the pressure feed line 12 via the second line section 12".

Figure 7:
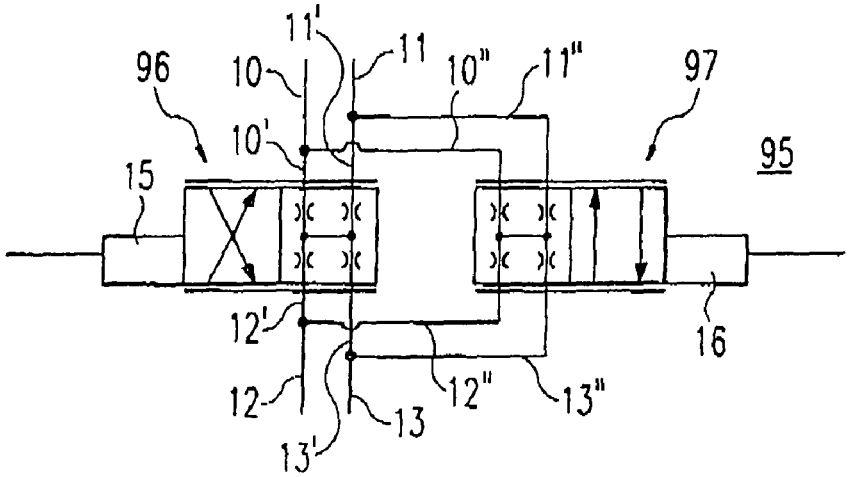
FIG. 7 shows a further alternative embodiment with two directional control valves.

Alternatively to the proportional directional control valve unit 91, according to a further embodiment the further proportional directional control valve unit 95 illustrated in FIG. 7 can be used. Instead of 3/2 directional control valves 92, 93, the proportional directional control valve unit 95 comprises a first 4/2 directional control valve 96 and a second 4/2 directional control valve 97. In contrast to the embodiment example illustrated in FIG. 6, in this case a connection between the first adjusting pressure line 10 and the pressure relief line 13 and simultaneously a connection of the second adjusting pressure line 11 to the pressure feed line 12 are generated solely by the first 4/2 directional control valve. In the respective initial position of the 4/2 directional control valves 96, 97 the appropriate line sections 12', 12" and pressure relief line sections 13', 13" are connected to one another. The connection of the first adjusting pressure line 10 to the pressure feed line 12 required to generate a reverse adjusting movement of the adjusting piston 5 with simultaneous connection of the second adjusting pressure line 11 to the pressure relief line 13, on the other hand, takes place via the second 4/2 directional control valve 97. When one of the two 4/2 directional control valves 96, 97 is charged with an adjusting force by electromagnet 15 or electromagnet 16, the other 4/2 directional control valve 97, 96 in each case remains in its respective initial position, in which, in a way not illustrated, it is held by a spring, for example. In this initial position all four connections of the respective 4/2 directional control valve are connected to one another in throttled manner.

Figure 8:
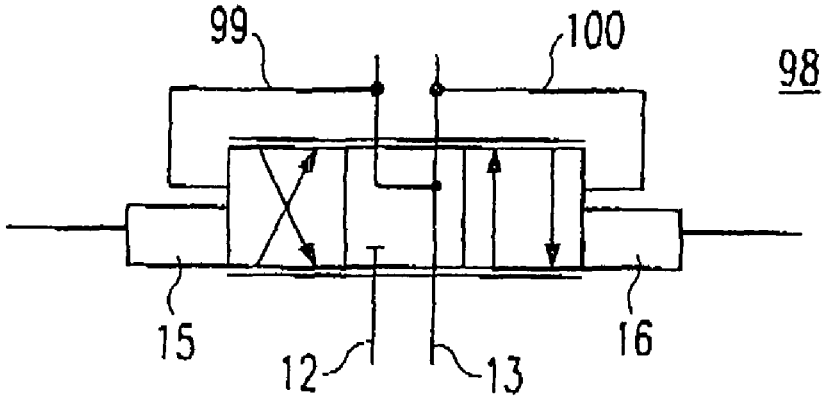
FIG. 8 shows a second alternative control pressure-regulating valve.

FIG. 8 shows a further embodiment example in which the control pressure regulating valve 9 is designed as a pressure-reducing valve 98. The pressure-reducing valve 98 is a 4/3 directional control valve in which in the neutral position the first and the second adjusting pressure lines 10, 11 are connected jointly to the pressure relief line 13. The pressure prevailing in the first adjusting pressure line 10 is fed via a first measuring line 99 to a measuring surface of the pressure-reducing valve 98 and there acts in the same direction as a force generated by the first electromagnet 15. In the opposite direction the pressure prevailing in the second control pressure line 11 acts on the pressure-reducing valve 98 via a second measuring line 100 in the same direction as the force of the second electromagnet 16. When the pressure-reducing valve 98 is charged with a force by the first electromagnet 15, the pressure-reducing valve 98 is adjusted into the direction of its first end position. In the first end position of the pressure-reducing valve 98 the pressure-feed line 12 is connected to the second control pressure line 11. This increases the pressure prevailing in the second adjusting pressure chamber 7 and thus also the pressure prevailing in the second adjusting pressure line 11. An increase in pressure by adjusting the pressure-reducing valve 98 into the direction of its first end position will therefore take place until a balance of forces between the pressure fed via the second measuring line 100 and the adjusting force generated by electromagnet 15 has been reached.

The second electromagnet 16 is appropriately actuated to effect a displacement of the adjusting piston 5 in the opposite direction. A balance of forces arises between the hydraulic force which acts on the pressure-reducing valve 98 in the opposite direction to the force of electromagnet 16 and the adjusting force of electro-magnet 16.

Figure 9:
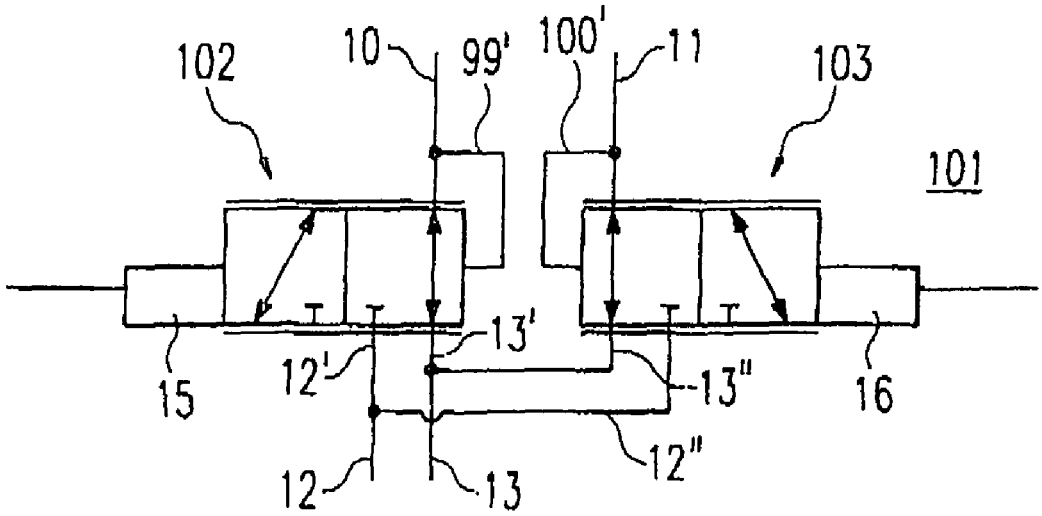
FIG. 9 shows an alternative embodiment to the control pressure-regulating valve according to FIG. 8 with two pressure-reducing valves.

FIG. 9 illustrates an alternative to the pressure-reducing valve 98 designed as a 4/3 directional control valve, a pressure-reducing valve unit 101, in which two 3/2 directional control valves 102, 103 jointly form the pressure-reducing valve unit 101. The mode of operation substantially corresponds to that of the pressure-reducing valve 98. However, each 3/2 directional control valve 102, 103 is assigned to an adjusting pressure chamber 6, 7. For connecting the third 3/2 directional control valve 102 and the fourth 3/2 directional control valve 103 to the pressure feed line 12 and the pressure relief line 13 the pressure feed lines 12 again divide into a first line section 12' and a second line section 12" and the pressure relief line into a first pressure relief line section 13' and a second pressure relief line section 13". The corresponding measuring lines 99', 100' of the first and the second adjusting pressure lines 10, 11 act on measuring surfaces and are directed in the opposite direction to the adjusting force of electromagnets 15 or 16. Charging of the first electromagnet 15 leads to charging of the first adjusting pressure chamber 6 with increasing pressure. Energising the second electromagnet 16 results in an adjusting movement in the opposite direction.

The invention is not confined to the embodiment example illustrated. In fact, any number of combinations of the features illustrated and explained in the drawings is possible.

The invention claimed is:

1. A regulating device for a hydrostatic piston engine with a feedback element for scanning an adjusting position of the hydrostatic piston engine, wherein the regulating device comprises an electronic control unit for generating adjusting signals and the electronic control unit comprises a sensor element for contactless detection of the scanned adjusting position and the feedback element comprises a shaft which is held rotatably in the regulating device.

2. The regulating device according to claim 1, wherein the regulating device comprises at least one first housing part for accommodating the electronic control unit and a second housing part for accommodating the feedback element.

3. The regulating device according to claim 2, wherein the first housing part is sealed against the second housing part.

4. The regulating device according to claim 1, wherein a magnetic element is arranged on the feedback element and a magnetically sensitive sensor element is provided in the electronic control unit.

5. The regulating device according to claim 1, wherein the shaft is connected non-rotatably to a feedback lever for converting a linear movement into a rotational movement.

6. The regulating device according to claim 4, wherein the magnetic element is arranged on the shaft.

7. The regulating device according to claim 1, wherein the sensor element comprises a Hall sensor.

8. The regulating device according to claim 1, wherein the sensor element comprises a magneto-resistive sensor.

9. The regulating device according to claim 1, wherein the electronic control unit comprises a temperature sensor.

10. The regulating according to claim 2, wherein the first housing part and the second housing part are made of a metal material.

* * * * *